US006073561A

United States Patent [19]

Theurer et al.

[11] Patent Number: 6,073,561

[45] Date of Patent: Jun. 13, 2000

[54] BOX CAR FOR TRANSPORTING BULK MATERIAL

[75] Inventors: Josef Theurer, Vienna; Manfred Brunninger, Altenberg, both of Austria

[73] Assignee: Franz Plasser Bahnbaumaschinen-Industriegesellschaft m.b.H., Vienna, Austria

[21] Appl. No.: 09/076,746

[22] Filed: May 12, 1998

[30] Foreign Application Priority Data

May 28, 1997 [AT] Austria ..... 910/97

[51] Int. Cl.[7] ..... B61D 3/00

[52] U.S. Cl. ..... 105/239; 105/247; 104/7.3

[58] Field of Search ..... 105/239, 238.1, 105/247, 311.1; 104/2, 7.3

[56] References Cited

U.S. PATENT DOCUMENTS 4,809,617 3/1989 Theurer et al. .

5,400,718 3/1995 Theurer et al. .

FOREIGN PATENT DOCUMENTS 2 264 275 8/1993 United Kingdom .

*Primary Examiner*—S. Joseph Morano
*Assistant Examiner*—Robert J. McCarry, Jr.
*Attorney, Agent, or Firm*—Collard & Roe, P.C.

[57] ABSTRACT

A box car for transporting bulk material comprises a frame supported on undercarriages running on a track, a box supported on the frame for storing the bulk material, a bottom conveyor band arranged in the box, the bottom conveyor band being reversibly drivable in opposite conveying directions, and an inclined transfer conveyor band projecting beyond one end of the box car. A chute is arranged at an end of the box car opposite the one end and spaced from the transfer conveyor, an end of the bottom conveyor band being associated with the chute, a hopper is associated with the chute for discharging bulk material into the hopper, and a charging conveyor band has a discharge end above the hopper, the charging conveyor band being displaceable in the longitudinal direction.

7 Claims, 1 Drawing Sheet

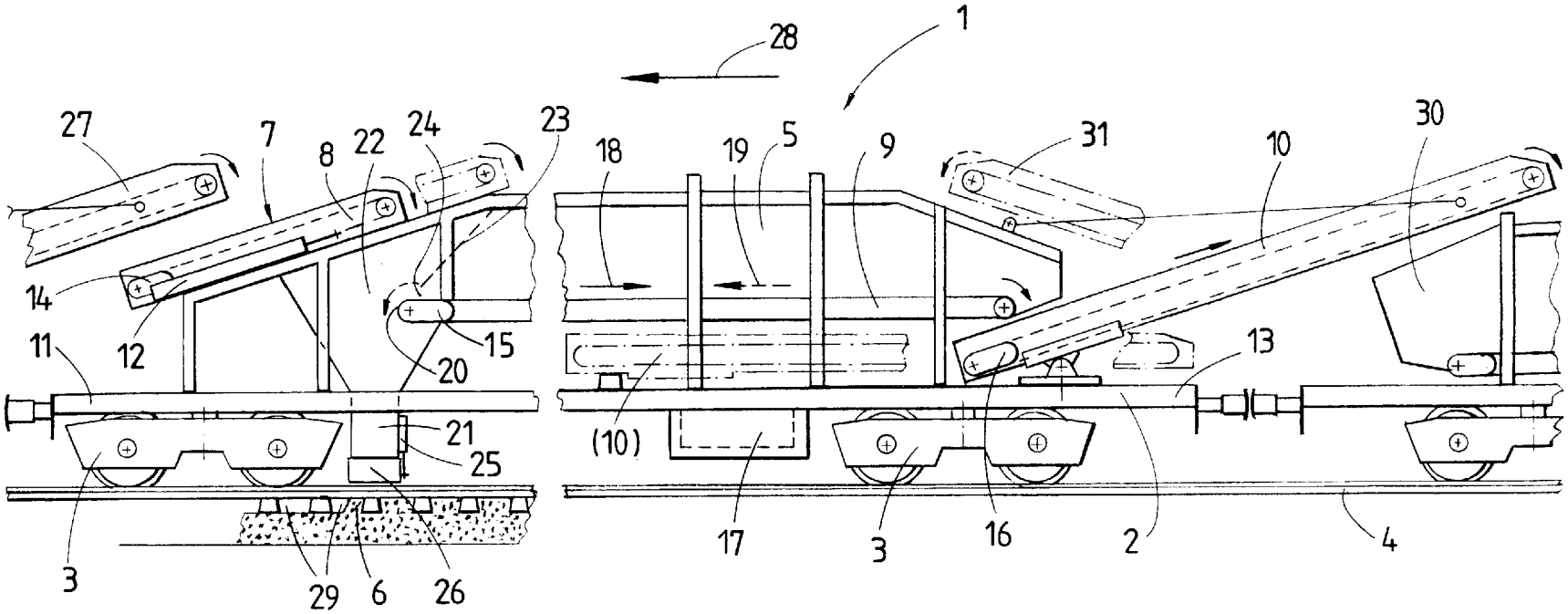
1
2
3
4
5
6
7
8
9
10
11
12
13
14
15
16
17
18
19
20
21
22
23
24
25
26
27
28
29
30
31
(10)

BOX CAR FOR TRANSPORTING BULK MATERIAL

BACKGROUND OF THE INVENTION

1. Field of the Invention

The present invention relates to a box car for transporting bulk material, the box car extending in a longitudinal direction and comprising a frame supported on undercarriages running on a track, a box supported on the frame for storing the bulk material, a bottom conveyor band arranged in the box and extending in the longitudinal direction, the bottom conveyor band being reversibly drivable in opposite conveying directions, an inclined transfer conveyor band projecting beyond one end of the box car, and a chute arranged at an end of the box car opposite the one end and spaced from the transfer conveyor, an end of the bottom conveyor being associated with the chute.

2. Description of the Prior Art

U. S. Pat. No. 5,400,718 discloses a box car of this general type. In track maintenance work, a number of such box cars are usually coupled together to make up a freight train, a series of overlapping conveyors enabling bulk material, such as ballast, to be conveyed along the entire train or to be stored in the box cars. The conveyors comprise bottom conveyor bands arranged in the box cars and transfer conveyor bands projecting from the box car ends to the adjacent box cars. Such box cars may also be used to discharge ballast on the track, for which purpose a chute is provided. The chute is arranged at an end of the box car opposite the one end and spaced from the transfer conveyor, an end of the bottom conveyor being associated with the chute. A bottom conveyor band drive enables a first conveying direction from the bottom conveyor band to the transfer conveyor band to be reversed to convey the ballast stored in the box car from the box car into the chute whence it is discharged to the track through a discharge opening which may be regulated by a metering device so that a metered amount of ballast is thrown on the track.

A similar box car has been disclosed in U. S. Pat. No. 4,809,617. In this case, a respective discharge chute is associated with each rail of the track below the transfer conveyor band. A V-shaped deflecting baffle above the transfer conveyor band may be lowered onto the transfer conveyor band and adjusted so that the ballast may be directed to both chutes.

SUMMARY OF THE INVENTION

It is a primary object of this invention to improve a box car of the first described type in a structurally simple manner so that it may be used for delivering predetermined amounts of bulk material, such as ballast, to predetermined track points as well as being capable to be coupled to like box cars to form a freight train for transporting the bulk material and being automatically loaded and unloaded.

The above and other objects are accomplished in accordance with the invention by equipping such a box car with a hopper associated with the chute for discharging bulk material into the chute, and a charging conveyor band extending in the longitudinal direction and having a discharge end above the hopper, the charging conveyor band being displaceable in the longitudinal direction.

Such a box car may be used for delivering ballast to a track in the course of a track rehabilitation operation. In such an operation, ballast is discharged primarily in the track cribs between the ties. The ballast to be discharged may be delivered by a conveyor band arrangement, for example, from a ballast cleaning machine or any other type of ballast excavating machine, and is discharged from a chute arrangement. The delivered amount of ballast may vary because of different amounts of waste having been removed from the ballast during cleaning, for instance, and such variations may be readily equalized with such a box car. If the delivered amount of ballast is too large, the excessive ballast is delivered to the box for storage, instead of the chute, simply by displacing the charging conveyor band. Larger amounts of bulk material are transported in the box car. By reversing the conveying direction of the bottom conveyor band, additionally required amounts of ballast may be delivered from the box to the chute for discharge.

BRIEF DESCRIPTION OF THE DRAWING

The above and other objects, features and advantages of the present invention will become more apparent from the following detailed description of a now preferred embodiment thereof, taken in conjunction with the accompanying single FIGURE of the drawing showing a side elevational view of a box car according to this invention

DETAILED DESCRIPTION OF THE PREFERRED EMBODIMENT

As shown in the drawing, box car 1 for transporting bulk material extends in a longitudinal direction and comprises frame 2 supported on undercarriages 3, 3 running on track 4. Box 5 is supported on frame 2, being affixed thereto for transporting, storing and discharging bulk material, such as ballast 6, for which purpose conveyor arrangement 7 is associated with the box car. Conveyor arrangement 7 consists essentially of three conveyor bands extending sequentially in the longitudinal direction, i.e. charging conveyor band 8 driven by drive 14, horizontally extending bottom conveyor band 9 arranged in box 5, and inclined transfer conveyor band 10 driven by drive 16 and projecting beyond one end 13 of box car 1. Bottom conveyor band 9 is reversibly drivable by drive 15 in opposite conveying directions 18, 19. Conveyor band drives 14, 15, 16 receive power from common power source 17. Two chutes 21 are arranged at end 11 of the box car opposite the one end 13 and spaced from the transfer conveyor, end 20 of bottom conveyor band 9 being associated with chutes 21. The chutes are spaced from each other transversely to the longitudinal direction for association with the respective rails of track 6 so that they may discharge ballast 6 at the points of the ballast supporting the track rails. Hopper 22 is associated with chutes 21 for discharging bulk material into the chute. The hopper is positioned outside box 5 underneath a discharge end of charging conveyor band 8 and above chutes 21. Hopper 22 and chutes 21 are positioned immediately ahead of a rear one of the undercarriages 3 in conveying direction 18, and charging conveyor band 8 has a discharge end above the hopper, the charging conveyor band being displaceable in the longitudinal direction by drive 12 and being mounted at end 11 of box car 1 opposite the one end from which transfer conveyor band 10 projects.

Transfer conveyor band 10 is retractible from an operating position wherein it projects beyond the one end 13 of box car 1 (shown in full lines) into a rest position (shown in phantom lines) wherein it extends parallel to frame 2 between the frame and bottom conveyor band 9. Drive means for effectuating this repositioning of transfer conveyor band 10 are conventional and are, therefore, not illustrated so that the drawing may not be unnecessarily cluttered.

End wall 23 of box 5 constituting the rear end wall with respect to conveying direction 18 forms a part of hopper 22, rear end wall 23 of the box inclining towards the one conveying direction 18 as it assumes an increasing vertical distance from the bottom conveyor band. The rear end wall of the box and bottom conveyor band 9 define opening 24 therebetween for discharging bulk material from the bottom conveyor band into chutes 21.

Drive 12 is arranged to displace charging conveyor band 8 between a first discharge position being a rear position with respect to the conveying direction for charging bulk material into hopper 22 and a second discharge position being a forward position with respect to the conveying direction for charging bulk material into box 5. The rear position is shown in full lines while the forward position is partially illustrated in phantom lines.

The box car further comprises a metering device associated with chute 21 for producing a metered discharge of bulk material from the chutes. The metering device comprises chute closures adjustable by drives 25 for regulating the amounts of bulk material discharge from the chutes, such metering devices being well known and having been disclosed, for example, in above-mentioned U. S. Pat. No. 5,400,718.

Depending on the amount of ballast required for producing a uniform distribution of ballast in the ballast bed, box car 1 may be operated in the following manner:

Ballast is delivered to the box car by conveyor band 27 of a ballast cleaning machine, any other type of track maintenance machine or a preceding box car coupled to box car 1, as the box car moves along track 4 in an operating direction indicated by arrow 28. If the delivered amount of ballast corresponds exactly to the amount required to be discharged from chutes 21, charging conveyor band 8 remains in the position shown in full lines in the drawing. The delivered ballast is discharged from charging conveyor band 8 into hopper 22 whence it flows into the chutes and is metered by metering device 26 for discharge primarily into cribs 29 of track 4.

If more than the required amount of ballast is delivered by charging conveyor band 8, drive 12 is operated to displace the charging conveyor band into its forward position shown in phantom lines so that the delivered ballast is discharged into box 5 while bottom conveyor band 9 is moved at a low speed in conveying direction 18 for storing the ballast in the box.

If box 5 is filled to capacity, transfer conveyor band 10 is operated to move in the direction indicated by arrow 18 to transfer the bulk material stored in box 5 to next adjacent box car 30.

If not enough ballast is delivered by charging conveyor band 8, ballast stored in box 5 may be conveyed into hopper 22 by operating drive 15 to reverse the movement of bottom conveyor band 9 and drive it in the opposite direction indicated by arrow 19. This will cause the ballast to flow through opening 24 into hopper 22 and chutes 21. If not enough ballast has been stored in box 5 to meet the requirements, transfer conveyor band 10 is moved into its rest position (see phantom lines), and additional ballast is delivered to box 5 by a transfer conveyor band 31 from another ballast transport car (not shown).

What is claimed is:

1. A box car for transporting bulk material, the box car extending in a longitudinal direction and comprising (a) a frame supported on undercarriages running on a track, (b) a box supported on the frame for storing the bulk material, (c) a bottom conveyor band arranged in the box and extending in the longitudinal direction, the bottom conveyor band being reversibly drivable in opposite conveying directions, (d) an inclined transfer conveyor band projecting beyond one end of the box car, (e) a chute arranged at an end of the box car opposite the one end and spaced from the transfer conveyor, (1) an end of the bottom conveyor band being associated with the chute, (f) a hopper arranged above with the chute for discharging bulk material into the chute, and (g) a charging conveyor band extending in the longitudinal direction and having a discharge end above the hopper, the charging conveyor band being displaceable in the longitudinal direction.

2. The box car of claim 1, wherein the hopper is positioned outside the box, and the hopper and the chute are positioned immediately ahead of a rear one of the undercarriages with respect to one of the conveying directions.

3. The box car of claim 1, wherein an end wall of the box constituting the rear end wall with respect to one of the conveying directions forms a part of the hopper, the rear end wall of the box inclining towards the one conveying direction as it assumes an increasing vertical distance from the bottom conveyor band.

4. The box car of claim 3, wherein the rear end wall of the box and the bottom conveyor band define an opening therebetween for discharging bulk material from the bottom conveyor band into the chute, and comprising a drive for reversibly driving the bottom conveyor band in said opposite directions.

5. The box car of claim 1, comprising a drive for displacing the charging conveyor band between a first discharge position being a rear position with respect to the conveying direction for charging bulk material into the hopper and a second discharge position being a forward position with respect to the conveying direction for charging bulk material into the box.

6. The box car of claim 1, wherein the transfer conveyor band is retractible from an operating position wherein it projects beyond the one end of the box car into a rest position wherein it extends parallel to the frame between the frame and the bottom conveyor band.

7. The box car of claim 1, further comprising a metering device associated with the chute for producing a metered discharge of bulk material from the chute.

* * * * *